United States Patent [19]

Fasano

[11] 4,080,765

[45] Mar. 28, 1978

[54] BUILDING STRUCTURE MADE OF PREFORMED REINFORCED ELEMENTS

[75] Inventor: Osvaldo Fasano, Villarbasse (Turin), Italy

[73] Assignee: Edilstart S.r.l., Turin, Italy

[21] Appl. No.: 751,834

[22] Filed: Dec. 17, 1976

[30] Foreign Application Priority Data

Dec. 19, 1975 Italy ..... 70147 A/75

[51] Int. Cl.[2] ..... E04C 3/10; E04C 3/26; E04C 5/08

[52] U.S. Cl. ..... 52/228; 52/583; 52/587; 52/250; 403/154; 403/153

[58] Field of Search ..... 52/250, 223, 227–230, 52/583, 578, 587, 601, 602; 403/297, 153–155

[56] References Cited

U.S. PATENT DOCUMENTS

| | | | |
|---|---|---|---|
| 1,150,044 | 8/1915 | Leonard | 52/583 |
| 1,684,663 | 9/1928 | Dill | 52/223 |
| 2,229,779 | 1/1941 | Thomas | 52/583 |
| 2,270,672 | 1/1942 | Heeren | 52/601 |
| 2,629,139 | 2/1953 | Thelander | 52/578 |
| 3,167,882 | 2/1965 | Abbott | 52/230 |
| 3,369,334 | 2/1968 | Berg | 52/584 |
| 3,585,771 | 6/1971 | Pinniger | 52/583 |

FOREIGN PATENT DOCUMENTS

| | | | |
|---|---|---|---|
| 253,219 | 4/1960 | Australia | 52/228 |
| 1,124,762 | 7/1956 | France | 52/583 |
| 514,653 | 2/1955 | Italy | 52/583 |

*Primary Examiner*—James L. Ridgill, Jr.
*Attorney, Agent, or Firm*—Sughrue, Rothwell, Mion, Zinn and Macpeak

[57] ABSTRACT

A modular building structure is assembled from a number of modular elements which form floors, walls, pillars and beams, each modular element comprising an internally reinforced block having external eyes or loops integral with the internal reinforcement and interlinked by linking elements which engage in superimposed eyes or loops of adjoining modular elements to tension the respective internal reinforcements and brace the modular elements together to form a rigid structure.

3 Claims, 17 Drawing Figures

102-104
106
107
108
110
110a
111
112
113
114
115
116
117
118
119
120
121
122
124
130
131
132
133
134
135

BUILDING STRUCTURE MADE OF PREFORMED REINFORCED ELEMENTS

The present invention relates to structures for use in the construction of prefabricated buildings and particularly to structures of the type comprising a number of modular structural elements having the functions of walls, pillars, beams of other structural elements intended to be interconnected upon assembly so as to form a rigid structure.

In order to facilitate assembly of structures from prefabricated modular elements the elements must be easy to handle and light and at the same time they must have high strength so as to allow the building of structures which are not only light but also relatively very strong. The rigidity of the resulting structure in particular depends upon the conditions in which the various structural elements are interconnected upon assembly. Therefore the means of interconnection and tightening of the various elements forming the structure are of considerable importance.

An object of the present invention is to provide a building structure composed of elements which apart from having high strength and being easy to handle, are also provided with means for their easy and rapid interconnection.

With the abovementioned object in view the present invention provides a building structure formed from a number of modular structural elements which serve as walls, pillars, beams, cladding or other structural elements, adapted to be interconnected upon assembly so as to form a rigid structure, each modular element comprising an internally reinforced block, characterised in that the internal reinforcement of each modular element has a number of appendices projecting outwardly from each of the faces of the element intended to be coupled with a corresponding face of an adjacent modular element, each appendix being in the form of an eye or loop adapted to be disposed side by side with a corresponding eye or loop of an adjacent modular element, and in that linking or bracing means are provided and are adapted to engage the cooperating eyes or loops in such a manner as to tension the internal reinforcements and to brace the adjacent modular elements against each other with adjacent faces in contact.

The building structure according to the present invention affords the practical advantages of ease of manufacture of the modular elements and ease of assembly and fixing thereof, the tensioning of the internal reinforcements upon interconnection of the elements serving both to hold the elements rigidly together and to prestress the individual elements.

The invention will now be further described, by way of non-limiting example, with reference to the appended drawings, in which.

Figure 1:
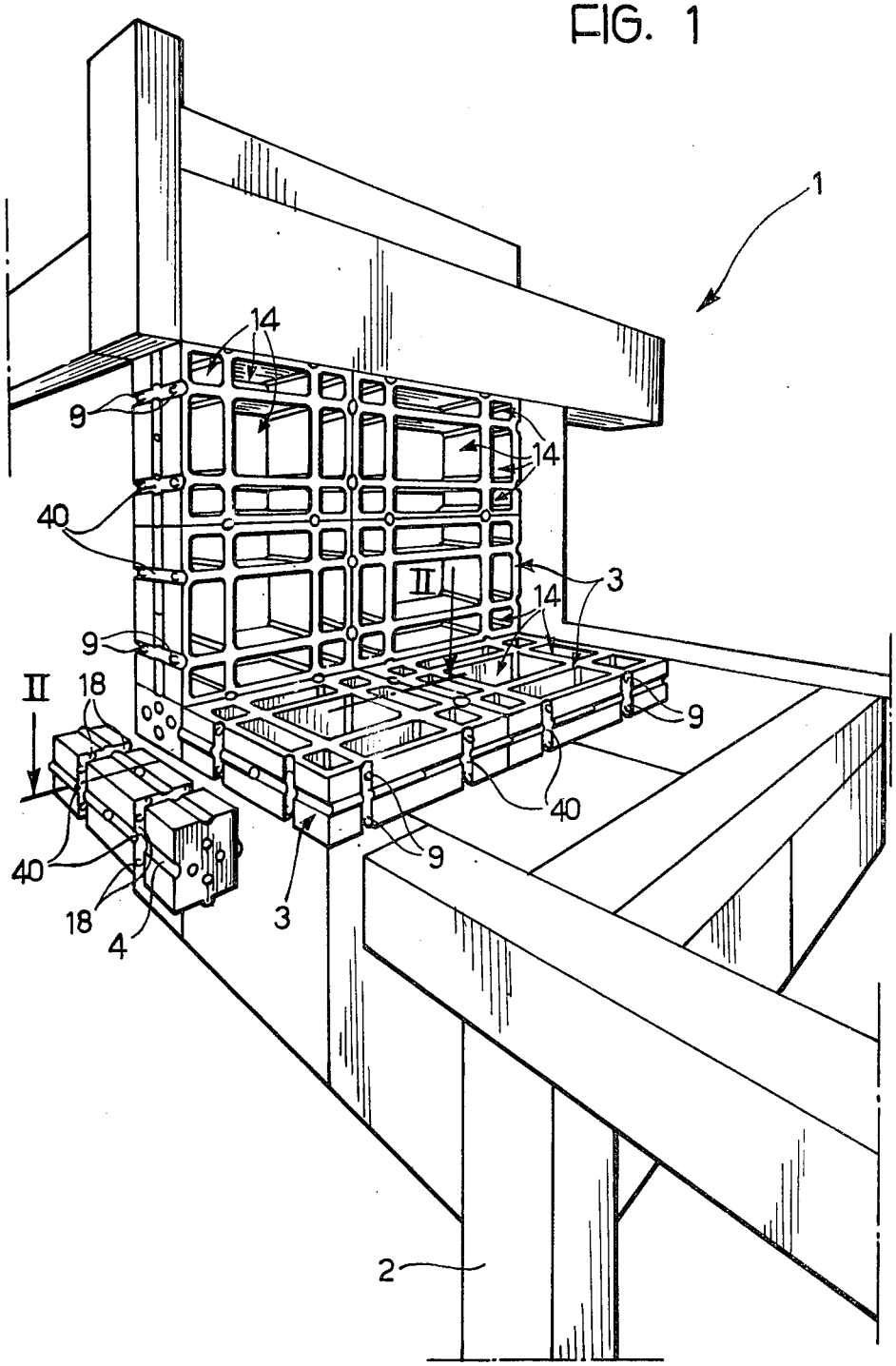
FIG. 1 is a partial perspective view of a structure according to a first embodiment of the invention.
Figure 2:
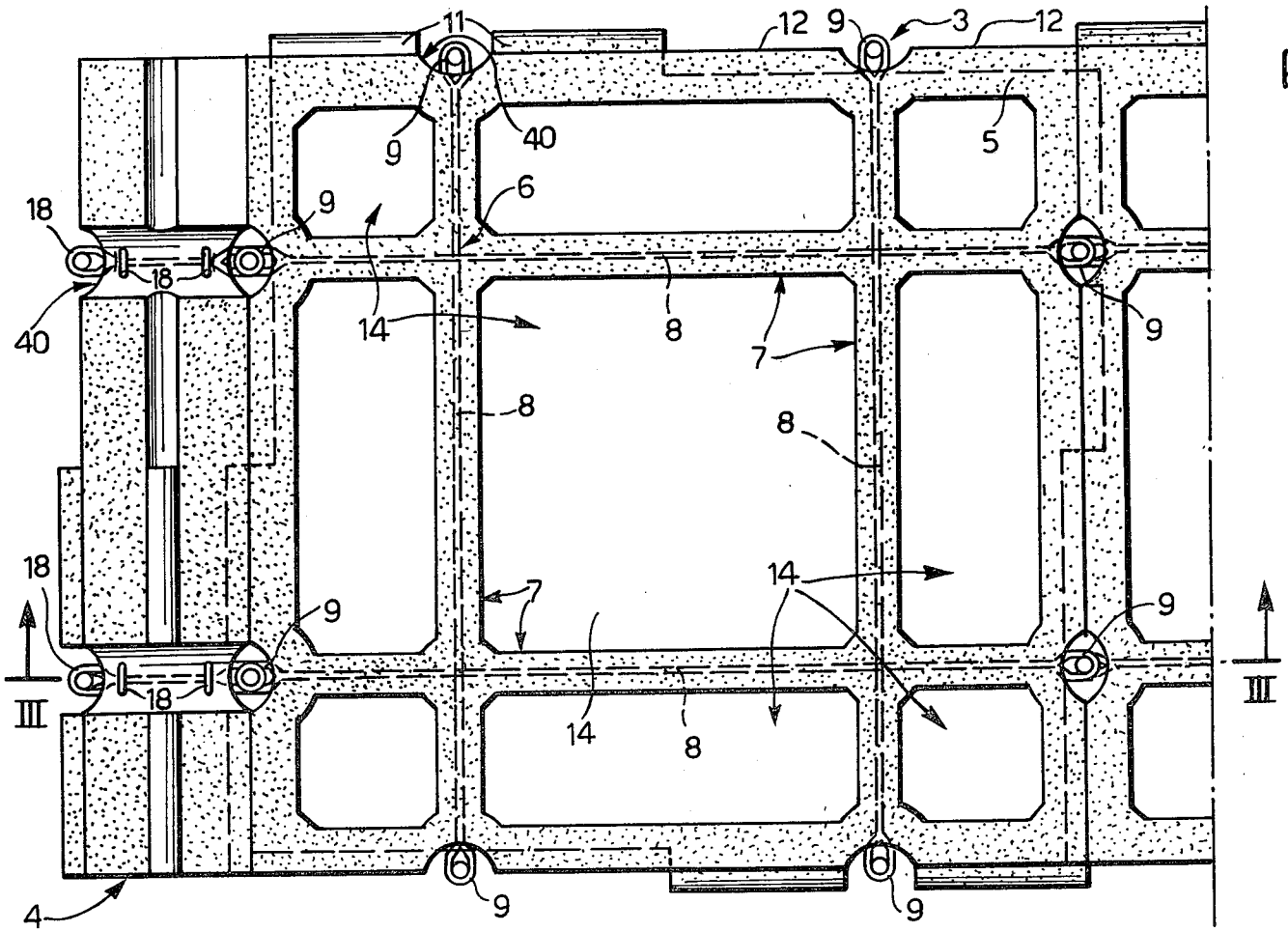
FIG. 2 is a partial plan view taken on line II—II of FIG. 1, on an enlarged scale.

In the embodiment illustrated in FIGS. 1 to 8, a number of elements of the modular type having different functions are mutually interconnected in such a manner as to form a unitary structure 1. The structure 1 is formed from modular elements 2 which form pillars, modular elements 3 which form walls and modular elements 4 which form beams. Each modular wall element 3 comprises a cast concrete block 5 in the form of a rectangular slab having an internal metal reinforcement 6. The reinforcement 6 is embedded within four bracing ribs 7 upstanding from and disposed perpendicularly to the base of element 3. The bracing ribs 7 are arranged in two intersecting pairs parallel to the opposite mutually perpendicular pairs of external side walls of the modular element 3. The reinforcement 6 in each bracing rib 7 comprises metal reinforcing rods 8 which extend through the ribs 7 between opposite sides of the block 5, intersecting one within the intersections of the mutually perpendicular ribs 7. The opposite ends of each reinforcing rod 8 project outwardly from the corresponding outer lateral faces of the side walls of the block 5 and are bent backwardly to form eyes 9. The metal reinforcement 6 also includes, in addition to the reinforcing rods 8, further reinforcing rods 10 disposed parallel to the base of the modular element 3.

Each of the modular wall elements 3 has on the outer faces of its four side walls raised longitudinally extending tongues 11 extending along part only of the length of each side wall, and longitudinally extending grooves 12 extending along the remaining part of the length of each side wall, such that the tongues 11 and grooves 12 of adjoining modular elements 3 interlock to form a wall. The modular elements 2 and 4 are similarly provided with interlocking male and female elements.

Each modular wall element 3 has a number of rectangular recesses 14, defined by the base and the bracing ribs 7 of the block 5, which serve to lighten the weight of the elements.

Figure 3:
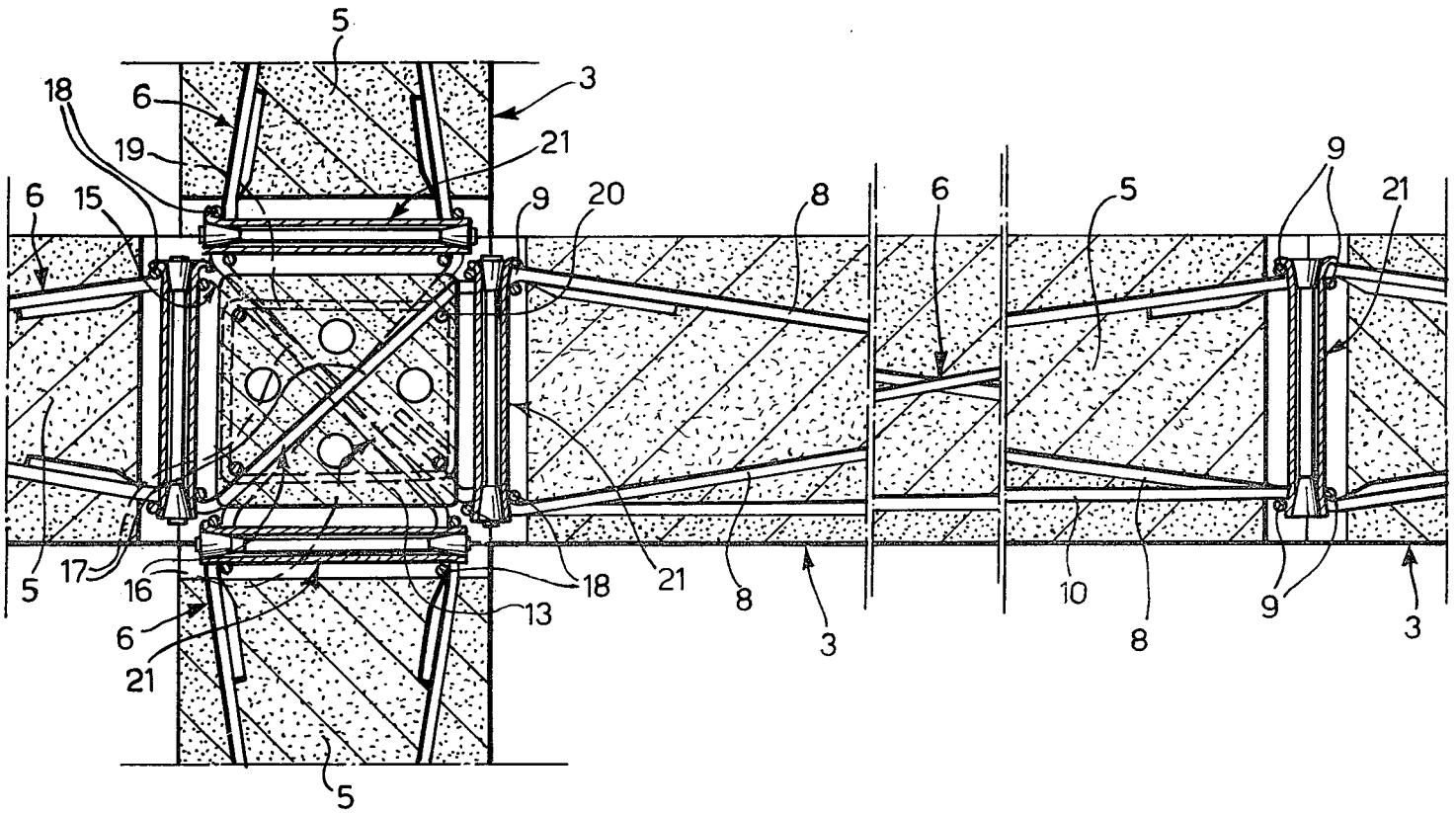
FIG. 3 is a partial cross section on an enlarged scale according to line III—III of FIG. 2.
Figure 4:
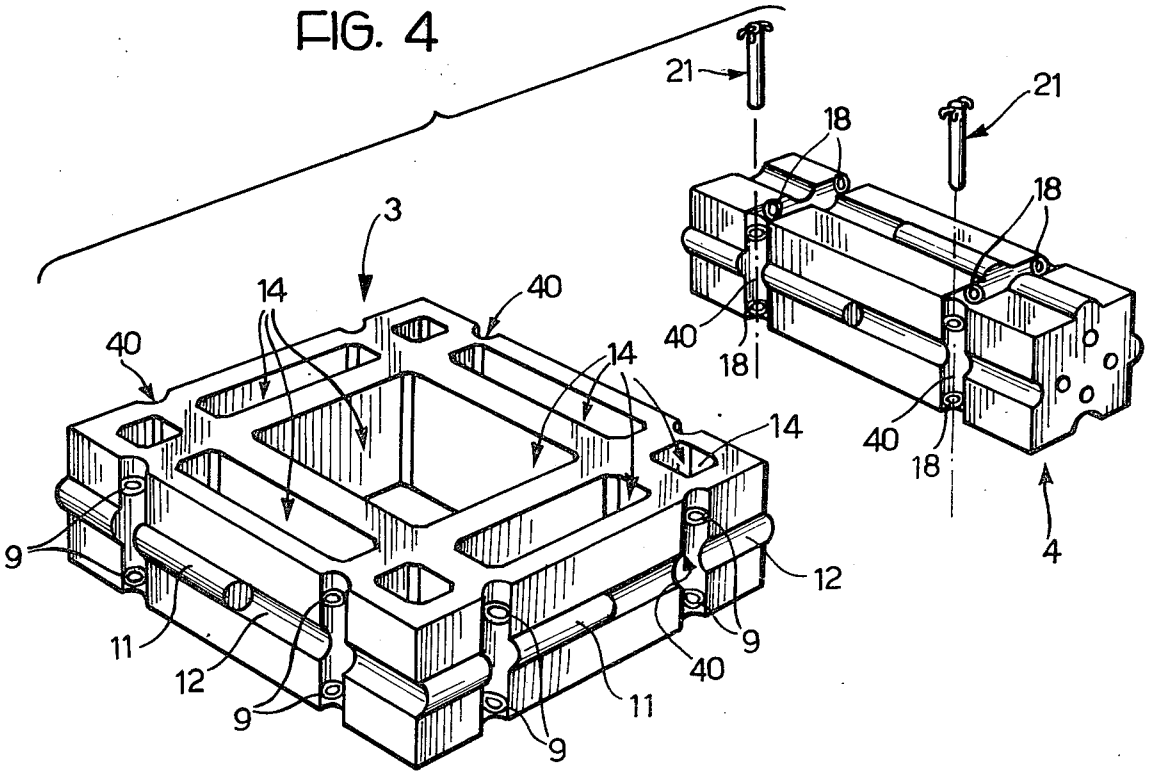
FIG. 4 is a perspective view, exploded and on an enlarged scale, of two of the modular elements employed in the structure of FIG. 1.
Figure 5:
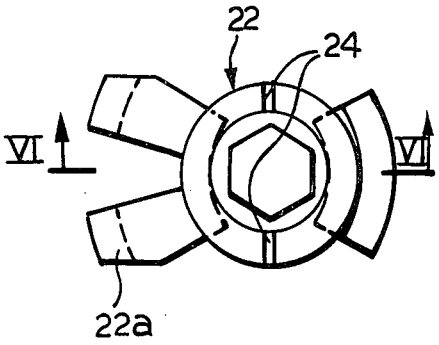
FIG. 5 is a plan view on an enlarged scale of one of the linking and bracing elements used in the assembly of the structure of FIGS. 1 to 3.
Figure 6:
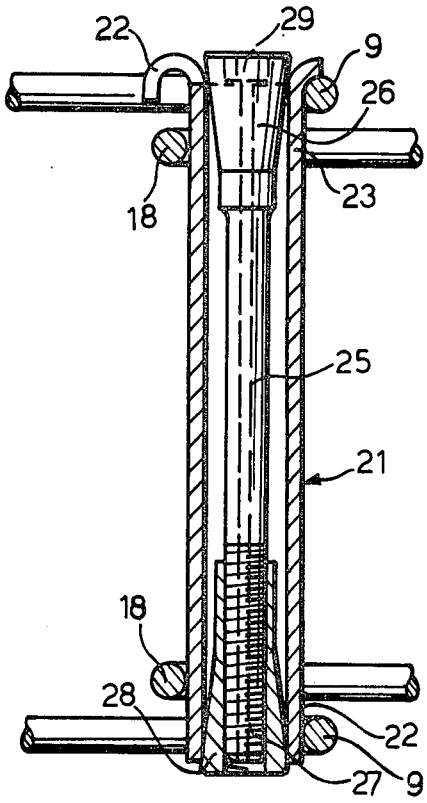
FIG. 6 is a cross section taken on line VI—VI of FIG. 5.

Each modular pillar element 2 and modular bean element 4 is formed of an elongate concrete body 13 having an internal metal reinforcement 15. The metal reinforcement 15 includes metal rods 17 disposed in planes 16 parallel to the longitudinal axis of the body 13. The elongate body 13 has a square cross section, the planes 16 being disposed in the two diagonals of this cross section, and the metal reinforcing rods 17 passing transversely through the body 13 from one corner to the other. Each end of each reinforcing rod 17 extends beyond to the corresponding corner of the body 13 and is bent backwards to form an eye 18. Each metal reinforcement 15 of the beam element 4 also includes metal reinforcing rods 19 and 20 extending transversely and longitudinally respectively (FIG. 3).

The disposition of the reinforcing rods 8 in the modular wall elements 3, and of the diagonal reinforcing rods 17 in the modular elements 2 and 4, is such that, in the assembled position of side by side contact of the modular elements the respective eyes 9 and 18 at the ends of these rods are disposed in pairs overlapping each other in such a manner that one eye of each said pair belongs to one of the modular elements and the other eye belongs to another, adjacent modular element. Furthermore, the positions of the pairs of overlapping eyes 9 and 18 are such that, in addition to overlapping, the eyes of each pair are parallel and only partly superimposed.

Upon assembly of a structure from the various modular elements adjacent pairs of overlapping eyes 9 and 18 are aligned with each other. A cylindrical linking and bracing element 21 is passed through the two aligned pairs of overlapping eyes, the opposite ends 22 and 23 of each element 21 being engaged in the respective pairs of overlapping eyes. The upper end 22 (FIG. 6) of each linking element 21 is provided with downwardly bent laterally outwardly extending tongues **22*a* intended to rest against the facing surfaces of the respective pair of overlapping eyes (FIG. 5) through which the upper end 22 of the element 21 passes. Each of the ends 22, 23 of the element 21 has a diametral slot 24 which permits radial expansion, by deformation, of the said end. EAch cylindrical element 21 is tubular and houses a central rod 25 provided at its upper end (FIG. 6) with a cone-shaped head 26, and externally screw-threaded at its lower end 27. The threaded end 27 receives a correspondingly internally threaded sleeve 28 having an external conical surface which tapers towards the head 26 and in the opposite direction to the latter. Upon assembly, the cone-shaped head 26 and the sleeve 28 are disposed, at least partly, externally of the corresponding ends 23 and 22 of the cylindrical element 21. The cone-shaped head 26 has a hexagonal cavity 29 in its end face for the reception of a correspondingly shaped hexagonal end of a key (not shown). By rotating the key in the appropriate sense it is possible to displace the sleeve 28 towards the cone-shaped head 26 and to cause a consequent progressive radially outward deformation of the two ends 22 and 23 of the element 21. This radial deformation tensions the reinforcing rods 8 and 17, thus bracing together adjoining pairs of interconnected modular elements. It will be noted that the deformability of the ends 22 and 23 of the cylindrical element 21 depends upon the tension which is applied to the eyes 9 and 18**, which opposes the deformation of the ends of the element. In this manner, the tightening of the assembled structure thus obtained is substantially balanced inasmuch as it tends to apply to each of the pairs of interconnected eyes a substantially equal tension load.

All the modular elements have an external circumferential groove 40 in which the eyes at the ends of the reinforcing rods are located, so that when adjoining modular elements are brought together for mutual interengagement as described above the overlapping pairs of eyes are located in channels formed by the cooperating grooves 40. These channels can be filled up, after assembly of a structure, with concrete, mortar, or other binding material used in building.

Figure 7:
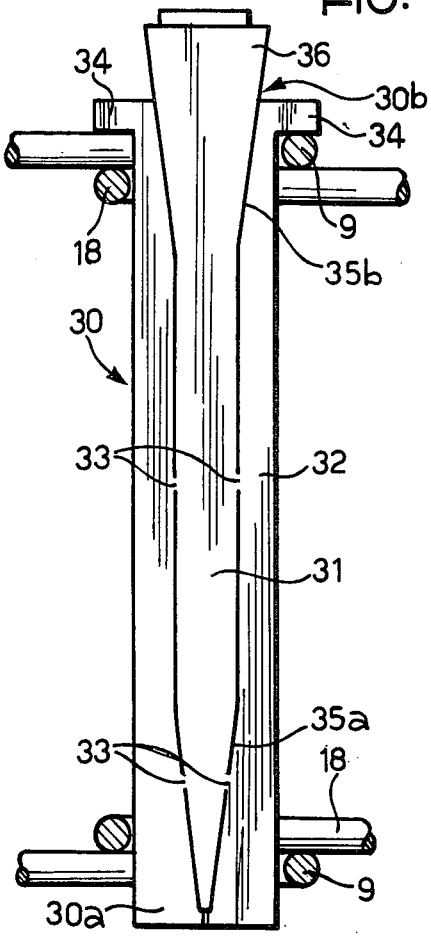
FIG. 7 is a cross section illustrating a variant of the linking and bracing element of FIG. 6.

FIG. 7 illustrates an alternative linking and bracing element 30 for structures not intended for the purpose of habitation, or for structures not meant to support high loads, such as, for example, supports for shop-windows and exhibitions. The linking and bracing element 30 has a rectangular body which is passed during the assembly through the aligned pairs of eyes 9, 18 of two spaced apart pairs of adjoining reinforcing rods. The rectangular element 30 comprises a central core 31 and a close-fitting external envelope 32 formed from the rectangular body 30 by means of a shearing operation which stamps out the core 31 from the envelope 32. The shearing operation is such that a few small bridging pieces 33 remain between the core 31 and the envelope 32. One end **30*a* of the rectangular element 30 passes through one pair of corresponding overlapping eyes and the other end 30*b* of the element 30 passes through another pair of overlapping eyes. Two laterally outwardly projecting lugs 34 are provided on the envelope 32 at the end 30*b* of the element 30 and are adpated to bear against the adjacent pair of overlapping eyes, retaining the element 30 in position. The ends 30*a* and 30*b* of both the core 31 and the envelope 32 project outwardly beyond the adjoining overlapping eyes and have mating conical surfaces 35*a* and 35*b* respectively which taper in the same direction (downwards in FIG. 7). In order to tighten the adjacent modular elements against each other upon assembly the enlarged end of the core 31 is struck in an axial direction. This causes rupture of the bridging pieces 33 and the wedging of the core 31 between the two halves of the envelope 32, forcing the two pairs of overlapping eyes 9, 18** to the displaced relative to each other, tensioning the respective reinforcing rods.

Figure 8:
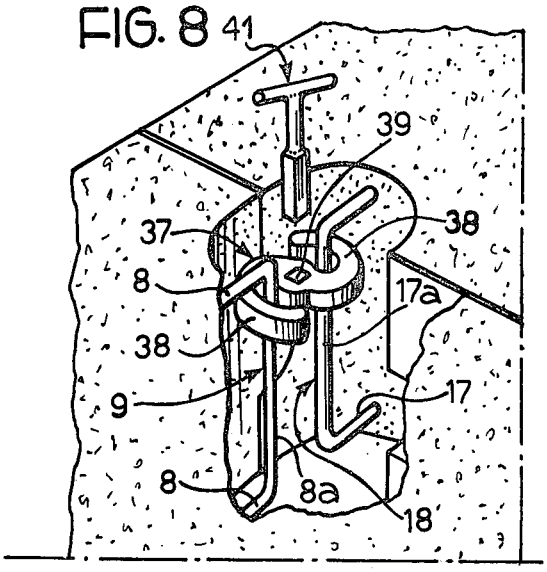
FIG. 8 is a perspective view partly cut away showing another form of linking and bracing element for use in the structure of the present invention.
Figure 9:
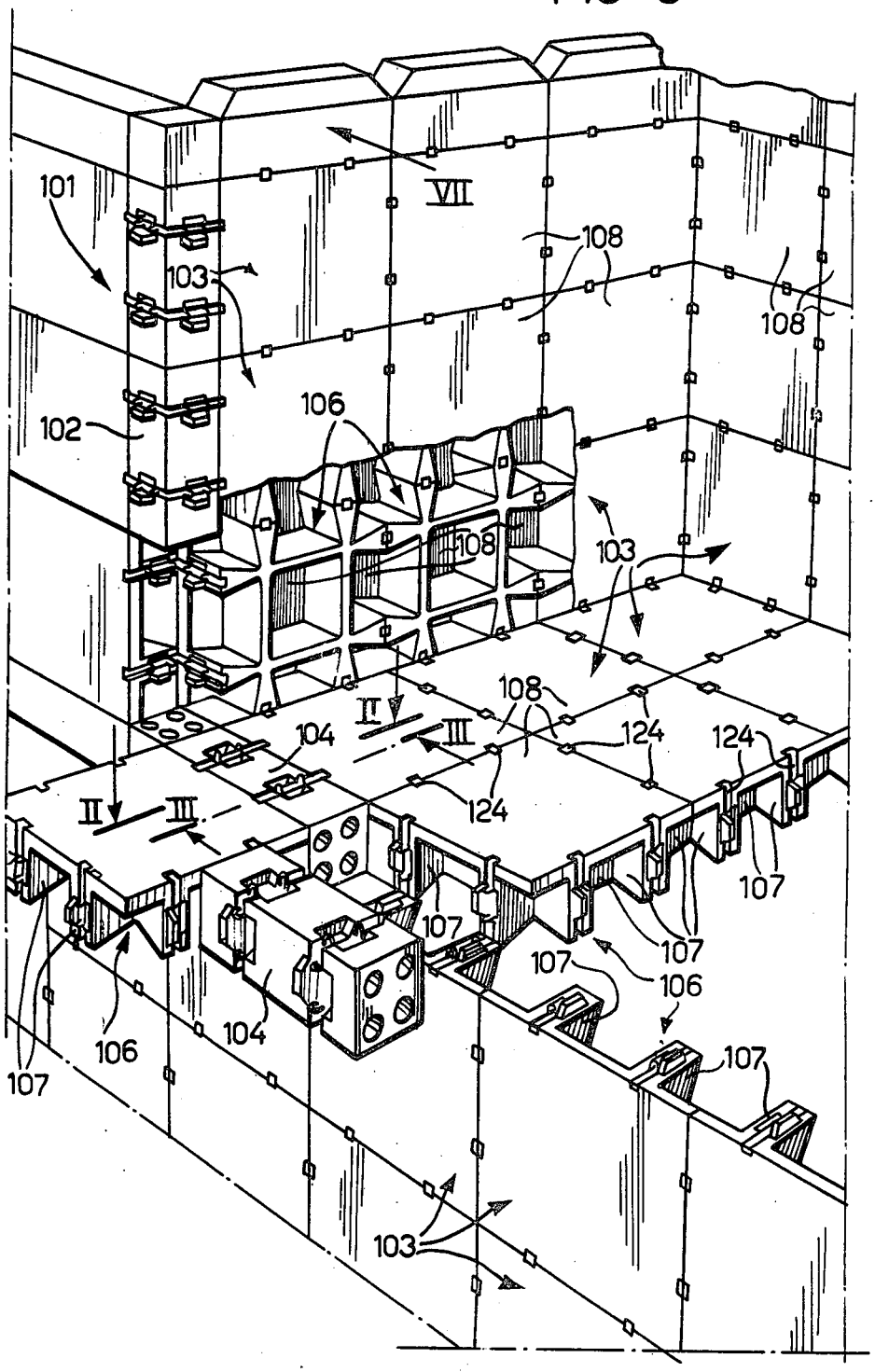
FIG. 9 is a partly cut away perspective view of a structure according to a second embodiment of the invention.
Figure 10:
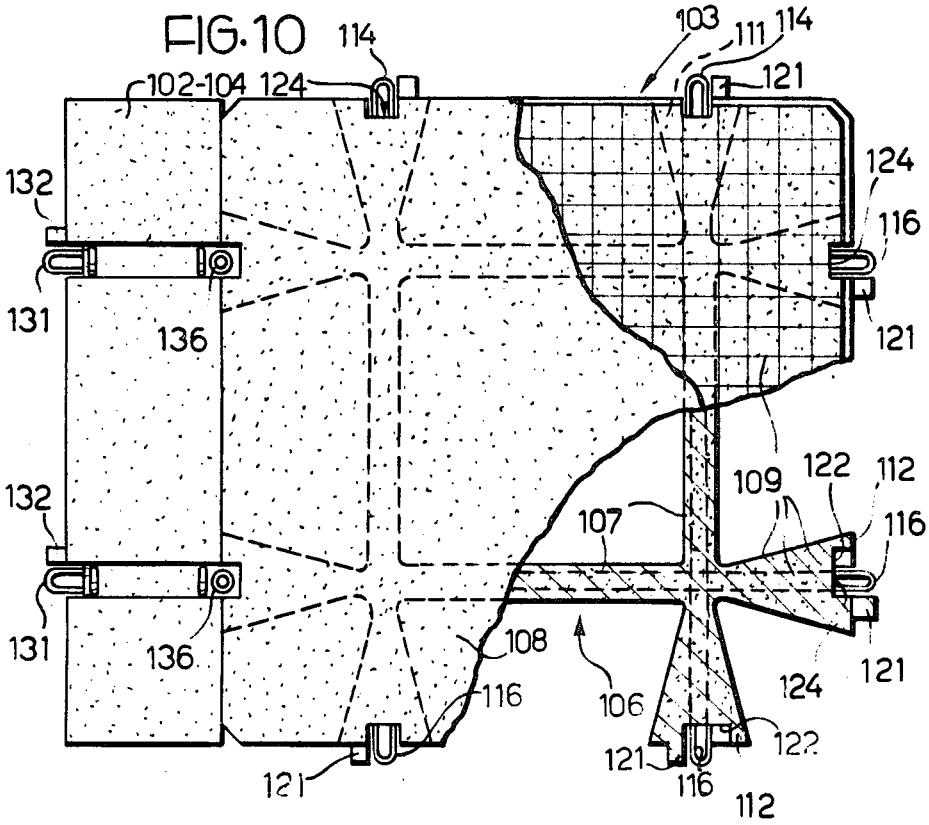
FIG. 10 is a partly cut away horizontal section taken on line X—X of FIG. 9.

FIG. 8 illustrates another form of linking and bracing element, also intended for use in structures to be subjected to low loads. The free ends of the reinforcing rods 8 and 17 are bent at right angles. The free ends of adjacent reinforcing rods 8 and 17 in each modular element being interconnected by linear portions **8*a* and 17*a* respectively. In this way each pair of reinforcing rod 8 forms an eye or loop 9 disposed in a semi-cylindrical groove in an end face of the modular element and each reinforcing rod 17 forms an eye or loop 18 disposed in a semi-cylindrical groove in an end face of an adjoining modular element, so that when the two modular elements are brought together with respective said grooves in register with each other to form a substantially cylindrical cavity, as shown in FIG. 8, the two linear portions 8*a* and 17*a* are disposed parallel to each other. The two said portions 8*a* and 17*a* of the eyes or loops 9 and 18 are interconnected by an S-shaped linking and bracing element 37 having spiral arms 38, 39 which engage the linear portions 8*a* and 17*a* of the two adjacent eyes or loops. By inserting a square-section key 40 in a square hole 39 in the central portion of the element 37 and rotating the key 40 the two eyes or loops 9 and 18 are drawn together, tensioning the respective reinforcing rods 8 and 17. More than one linking and bracing element 37 may be provided for each pair of eyes or loops 9 and 18**.

After assembly of a structure from modular elements as described the exposed surfaces of the structure may be clad with sheet material. During this operation all the unused eyes or loops disposed on the external surfaces of the walls are covered. Naturally before such cladding is carried out the modular elements are interconnected and braced together by linking or bracing elements as described. Such linking or bracing elements may also be used, in an analogous manner, for the attachement to the structure of cantilever members such as balconies.

In the embodiment illustrated in FIGS. 9 to 17, 101 indicates a modular structure in its entirety formed of a number of different types of modular element which serve different functions, interconnected rigidly so as to form a single structure. The illustrated structure is formed from flat modular elements 103 which form walls and floors or other level surfaces of the structure and elongate modular elements 102 and 104 which respectively form vertical pillars and horizontal beams of the structure.

Each flat modular element 103 is formed of a block of internally reinforced concrete cast with a square or rectangular flat base 108 and integral strengthening skeleton 106 on one face of the base 108. The strengthening skeleton 106 is formed of four ribs 107 arranged in two mutually perpendicular pairs, each rib 107 being perpendicular to the base and intersecting two of the other ribs in such a manner as to form a lattice. The flat base 108 acts as a load-bearing member. The modular element 103 is reinforced internally by metal reinforcing rods 109 and anchoring plates 110 enclosed within the concrete block which forms the modular element 103. Each anchoring plate 110 (FIG. 14) is cast within a respective rib 107 and is perpendicular to the length of the rib. Each rib 107 is delimited by two end faces 111 and 112 (FIG. 10) and is provided with four internal reinforcing elements 107*a* each of which is formed by a steel rod bent into a U-shape in a plane parallel to the length of the rib 107 and to the base 108, the free ends of each U-shaped rod being anchored within the rib 107 to the respective plate 110. Two of these rods, indicated by 113, are oriented in such a manner that the respective U-shaped loops 114 project beyond the end face 111 of the respective rib 107, whilst the other two rods, indicated by 115, project from opposite sides of the associated plate 110 from the rods 113 and are disposed in such a manner that the respective U-shaped loops 116 project beyond the end face 112 of the said rib 107.

Figures 12, 17:
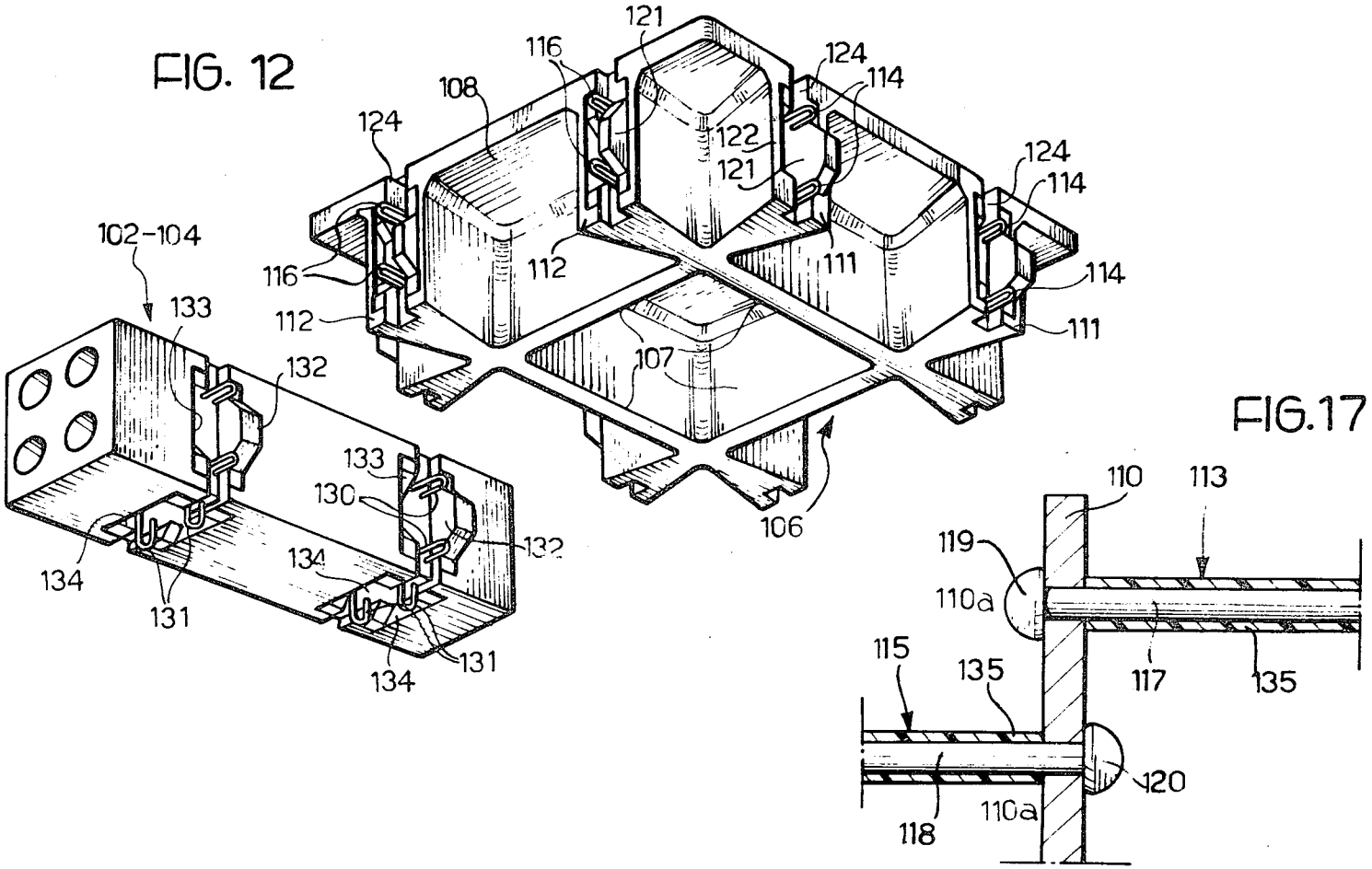
FIG. 12 is an exploded perspective view, on an enlarged scale of two of the modular elements employed in the structure of FIG. 9.
FIG. 17 is a cross section on an enlarged scale taken on line XVII—XVII of a detail of FIG. 14.

The parallel portions 117 of each rod 113 extend longitudinally within the respective rib 107 and pass through the respective plate 110 to which they are anchored. Similarly, the parallel portions 118 of each rod 115 extend longitudinally within the rib 107 and pass through the said plate 110 to which they are anchored. For this purpose, each plate 110 has eight holes 110*a* arranged in pairs to receive the parallel portions of the respective rods 113 and 115. The ends 119 and 120 of portions 117 and 118 are fixed to the associated plate 110 by means of riveting (FIG. 17).

Figure 13:
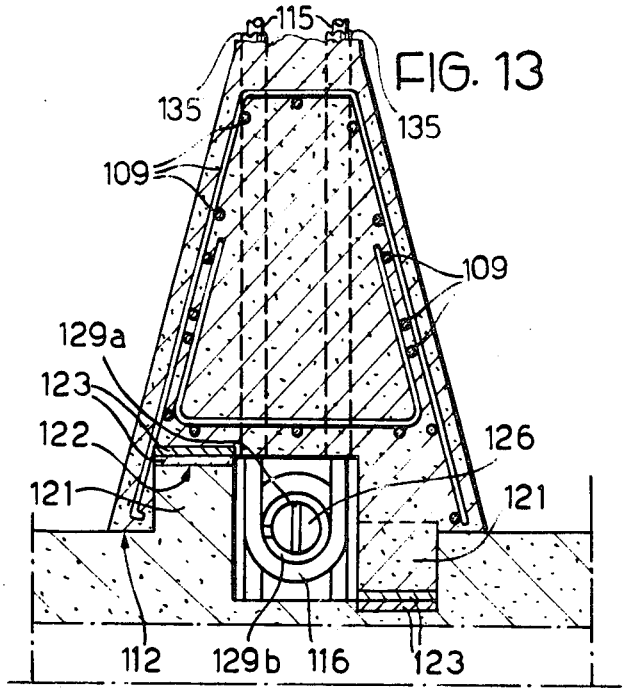
FIG. 13 is a part of FIG. 10 shown on an enlarged scale.
Figure 11:
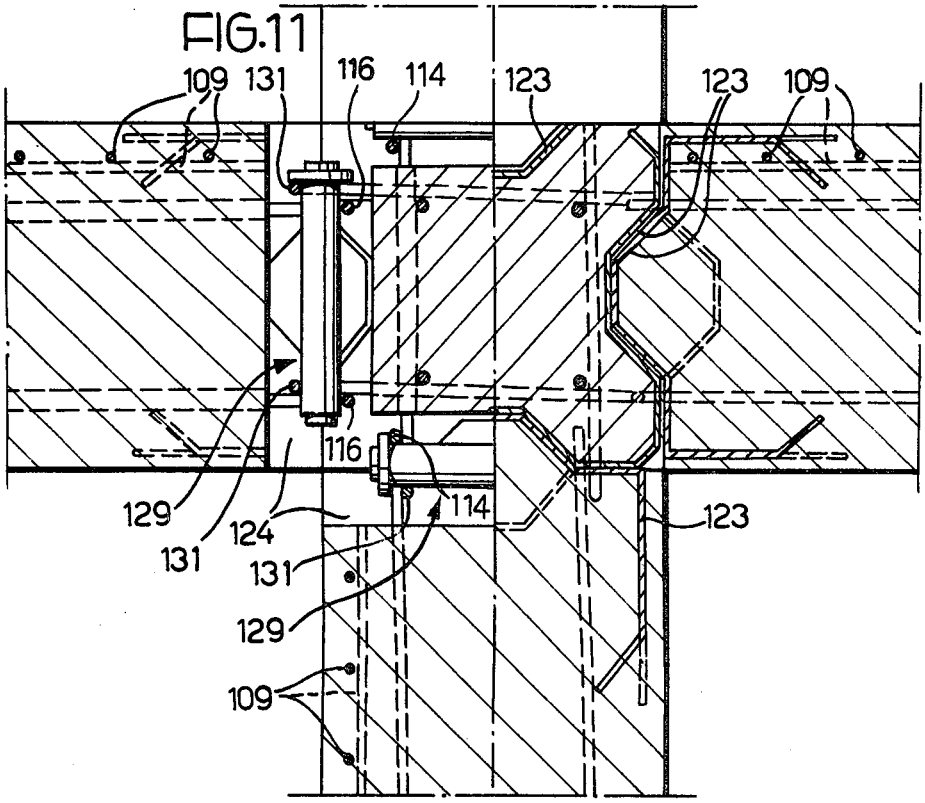
FIG. 11 is a partial vertical section taken on line XI—XI of FIG. 9.
Figure 14:
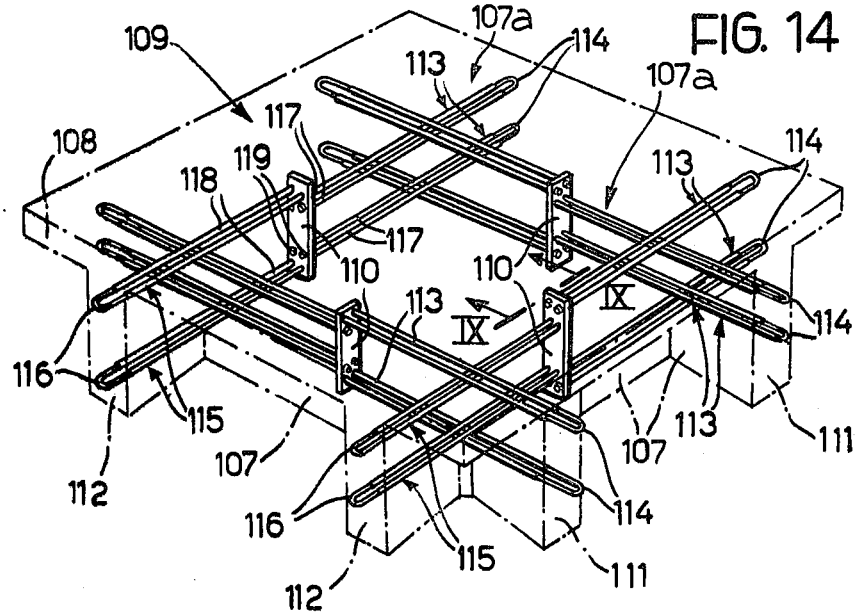
FIG. 14 is a perspective view of the internal reinforcing rods of a modular element of the structure of FIG. 9.

The parallel portions 117 and 118 of the reinforcing rods 113 and 115 are clad, at least in those parts which are embedded in the respective ribs 107, in cylindrical sheaths 135 of plastics material. The sheaths 135 prevent the rods 113 and 115 from bonding to the concrete and therefore facilitates sliding of the rods within the respective ribs 107, the rods being anchored to the structure of the respective modular element 103 only by means of the corresponding plate 110. The ends of each rib 107 are enlarged and have a trapezoidal shape in plan (FIG. 10), terminating in keys 121 which project beyond the respective end faces 111 and 112. Adjacent each key 121 the rib 107 is formed with a notch 122, the keys 121 and notches 122 being so located that upon assembly the keys 121 and notches 122 of adjoining end faces of adjacent modular elements 103 interengage. The ribs 121 and notches 122 are provided with flat end plates 123 which abut each other to allow accurate relative positioning of the ribs and notches upon assembly (FIG. 13). Furthermore each end face 111 and 112 of each rib 107 is provided with a recess 124 accommodating U-shaped projecting loops 114 and 116 of the reinforcing rods 113 and 115.

Upon assembly the modular elements 103 are arranged face to face so as to form the floors and other level surfaces and vertical walls. In the case of floors and level surfaces the base 108 of each element 103 is disposed uppermost and forms with adjacent elements 103 a level surface. The keys 121 and the notches 122 of each end face 111 and 112 of each modular element 103 are interengaged with the notches and keys of the corresponding end faces 111 and 112 of the adjacent modular elements 103. The U-shaped projecting loops 114 and 116 of the reinforcing rods of adjacent modular elements overlap to define substantially circular eyelets 136 within which respective cylindrical split sleeves 129 are located. Each sleeve 129 is split longitudinally into two half-sleeves 129*a*, 129*b* (FIG. 16), in a plane which curtains the longitudinal axis of the sleeve itself and is parallel to the two adjacent end faces of the two adjacent modular elements 103 interconnected by the sleeve. Within each split sleeve 129 there is inserted a pin 125. Each pin 125 has a flared conical head 126 at one end of a shank 127, the head 126 being provided with a laterally outwardly projecting tongue 126*a* which engages in the longitudinally extending gap between the two half-sleeves 129*a* and 129*b*. A nut 128 is threaded on the opposite end of the shank 127 from the head 126 and has an external frusto-conical surface tapering towards the head 126.

At the edges of floors or other level surfaces and of each vertical wall are disposed the elongate modular elements 102 and 104 respectively which form vertical pillars and horizontal beams of the composite structure. Each of the modular elements 102 and 104 is of square section and has four lateral faces. Each modular element 102 and 104 has internal reinforcing rods 130 with externally projecting U-shaped loops 131 which upon assembly are coupled with respective loops 114 and 116 of the reinforcing rods 113 and 115 of the adjoining modular elements 103 by means of pins 125 and split sleeves 129 as hereinbefore described.

On the faces which are vertically disposed upon assembly, each modular element 102 and 104 has outwardly projecting keys 132 and notches 133 of corresponding profile disposed adjacent the keys, corresponding to the keys 121 and notches 122 respectively of the modular elements 103, so that the modular elements can be interconnected with the keys and notches of adjacent elements interengaged. The faces of each modular element 104 which upon assembly are disposed horizontally do not have outwardly projecting keys but only notches 134.

The modular elements 103 which form vertical walls of the structure are mounted on the beam elements 104 in such a manner that the bases 108 of the elements are disposed either on the outside or on the inside according to requirements.

Figure 15:
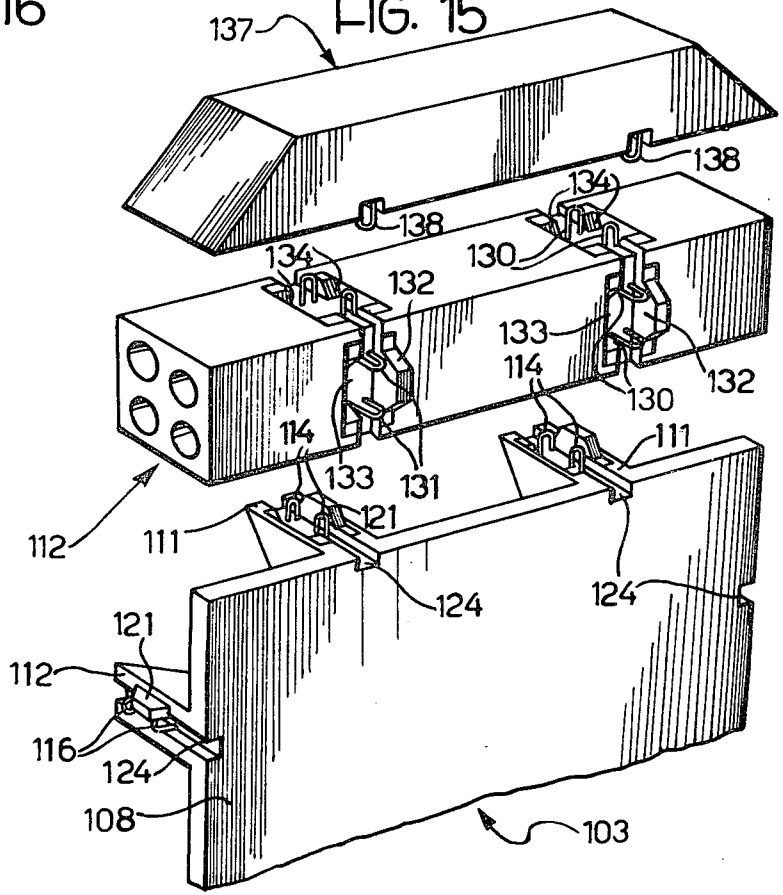
FIG. 15 is an exploded view on an enlarged scale of a detail of FIG. 9 viewed in the direction of the arrow XV.
Figure 16:
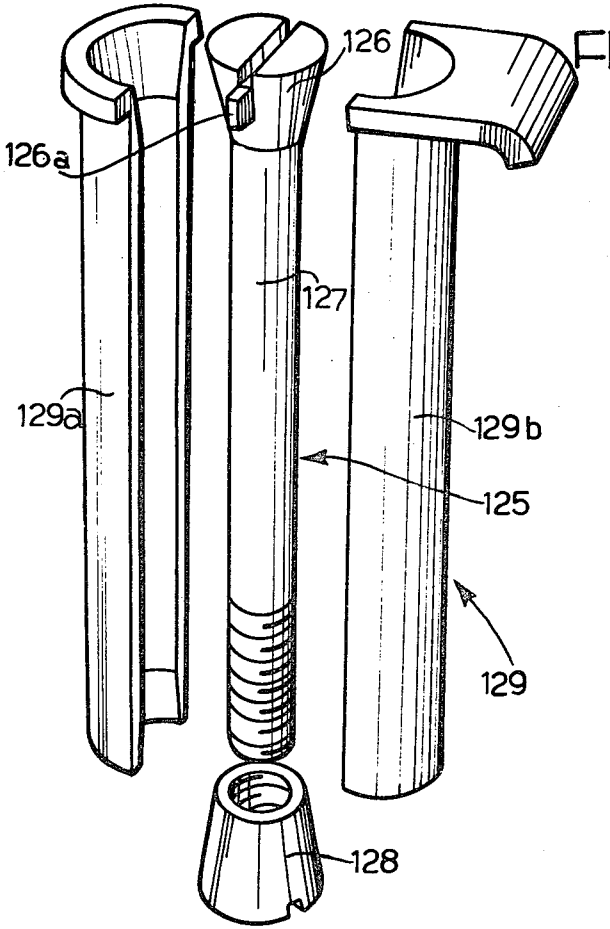
FIG. 16 is an exploded and enlarged view of one of the linking and bracing elements employed in the assembly of the structure of FIGS. 9 to 11.

Referring to FIG. 15, an elongate capping element 137 is fitted to exposed faces of the elongate modular elements 102 and 104 which serve respectively as pillars and beams in the assembled structure. Each element 137 has an internal reinforcement provided with anchoring eyes 138 for connection to corresponding eyes or loops of adjoining pillar and beam elements by means of pins 125 and split sleeves 129 as previously described.

When making flat elongate structures such as tracks, roads or the like, it is possible to provide on the exposed sides of such structures only the elongate capping elements 137, the modular pillar and beam elements 104 and 102 being then superfluous.

By tightening the nut 128 on each pin 125, the nut 128 is drawn towards the fixed head 126 of the pin and the opposing conical surfaces of the head and the nut push the two half-sleeves 129*a* and 129*b* radially outwards. As the two half-sleeves 129*a* and 129*b* are pushed apart they tend to enlarge the eyelets 136 formed by the overlapping eyes or loops 114, 116, 131 or 138, and by tightening the various nuts 128 in this way it is possible to tension the reinforcing rods 113 and 115 and to interconnect rigidly the various modular elements 102, 103 and 104, this prestressing of the reinforcing rods serving to establish a precompression of the concrete from which the modular elements are formed.

By cladding the parallel portions 117, 118 of each reinforcing rod 113, 115 within the block in which it is embedded relative sliding movement is permitted between each arm and the respective block, the extent of such sliding movement depending, for each type of construction, on the form and the nature of the cladding material. It is thus possible to achieve a load-transmitting capacity between adjoining modular elements of the assembled structure which can be suited to requirements of use. Because this capacity to transmit loads from one modular element to another depends on the elasticity of the connecting or linking means and in particular on the internal reinforcement, it is possible, by suitable selection of the form and material of the internal reinforcements, to achieve an optimum distribution of loads to be supported throughout the entire assembled structure.

The present invention therefore affords a modular system for constructing a rigid and unitary structure having considerable elastic capacity, especially if the internal reinforcements comprise rods of high elasticity steel such as, for example, spring steel. Structures obtained by means of the invention are, therefore, particularly capable of withstanding dynamic laods such as those arising from seismic disturbances.

The framework formed by the interconnected internal metal reinforcements furthermore forms a metal cage having the effect of a "Faraday cage" and acting as a barrier to electrical fields. This characteristic is particularly useful when using structures according to the invention in the electrical field, for example, for the construction of electrical or radio cabins.

It will be understood that many practical variations may be made in the embodiments described and illustrated, without departing from the scope of the invention.

For example, in order to facilitate the sliding of the internal reinforcing elements which carry the anchoring eyes or hooks, that is to say, the rods 8 in the modular elements of the embodiment illustrated in FIGS. 1 to 8 and the parallel sections 117 and 118 of the rods 113 and 115 of the second embodiment illustrated in FIGS. 9 to 17, the reinforcing elements may be clad either with sheaths of plastics material, as described with reference to the said second embodiment or with any other form of cladding, such as, for example, a simple varnish, which would prevent the concrete of the surrounding block from adhering to the reinforcing elements. It is also possible to cover the faces of the base of each of the modular elements 3 and 103, or the faces of the modular elements 2, 4 and 102, 104 which after assembly are exposed, with facing materials normally used in the building field. Similarly, it is possible to vary the materials used in the construction, the form of modular elements used in the structure and the means of interlinking and bracing the modular elements relatively to one another, without departing from the scope of the present invention.

I claim:

1. A building structure comprising a number of modular structural elements which serve as walls, pillars and beams and means for interconnecting said modular elements upon assembly to form a rigid structure, each modular element comprising an internally reinforced block the internal reinforcement of which has a number of appendices projecting outwardly from each of the faces of the element which upon assembly are coupled with a corresponding face of an adjacent modular element, each appendix including an eye adapted to be disposed side by side and partly superimposed with a corresponding eye of an appendix of an adjacent modular element, each pair of eyes superimposed being aligned upon assembly of the structure with another corresponding pair of eyes, an elongated body cooperating with every two aligned pairs of eyes, said elongated body having radially deformable ends housed within said aligned pairs of eyes, a conical member disposed at each end of the elongated body for cooperation with the radially deformable ends of the elongated body and means for effecting displacement of said conical members into the radially deformable ends of the elongated body so as to cause radial expansion of such ends to tension the superimposed eyes of each aligned pair.

2. A building structure as set forth in claim 1, wherein said elongated body is hollow and further comprising a central elongated pin extending through the hollow body, said conical members being connected to opposite ends of said pin by means permitting the movement of said conical members toward each other.

3. A building structure as set forth in claim 1, wherein said elongated body is comprised of a cylindrical hollow body split into two semi-cylindrical shells in a plane which contains the longitudinal axis of the cylindrical body and which is substantially parallel to the adjoining faces of two adjacent modular elements to be interconnected, a pin located within the cylindrical body and provided with enlarged end portions, said conical members being connected to opposite ends of said pin such that said conical members taper towards each other and are disposed prior to expansion of the elongated body at least partly externally of the two ends of the elongated body, and means for effecting relative displacement of the conical members toward each other into the opposite ends of the elongated body to cause radial separation of the two semi-cylindrical shells and tensioning of the eyes linked thereby.

* * * * *

UNITED STATES PATENT OFFICE

CERTIFICATE OF CORRECTION

Patent No. 4,080,765 Dated March 28, 1978

Inventor(s) Osvaldo FASANO

It is certified that error appears in the above-identified patent and that said Letters Patent are hereby corrected as shown below:

IN FOREIGN APPLICATION PRIORITY DATA:

Add -- June 30, 1976 (1st addition) Italy.....68605 A/76 --

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*